US007976443B2

(12) United States Patent
Krull

(10) Patent No.: US 7,976,443 B2
(45) Date of Patent: Jul. 12, 2011

(54) ADJUSTABLE WEIGHT KETTLEBELL

(76) Inventor: Mark A. Krull, Bend, OR (US)

( * ) Notice: Subject to any disclaimer, the term of this patent is extended or adjusted under 35 U.S.C. 154(b) by 0 days.

(21) Appl. No.: 12/590,354

(22) Filed: Nov. 6, 2009

(65) Prior Publication Data

US 2010/0120588 A1 May 13, 2010

Related U.S. Application Data

(60) Provisional application No. 61/198,619, filed on Nov. 7, 2008, provisional application No. 61/205,509, filed on Jan. 20, 2009.

(51) Int. Cl.
*A63B 21/075* (2006.01)

(52) U.S. Cl. ..... 482/108; 482/107; 482/908

(58) Field of Classification Search ..... 482/44, 482/49, 50, 92–94, 98, 99, 105–110, 141, 482/908
See application file for complete search history.

(56) References Cited

U.S. PATENT DOCUMENTS

| | | | | | |
|---|---|---|---|---|---|
| 90,304 | A * | 5/1869 | Reilly | 482/94 |
| 1,138,196 | A * | 5/1915 | Diehl | 482/106 |
| 1,316,683 | A * | 9/1919 | Calvert | 482/93 |
| 1,779,594 | A * | 10/1930 | Hall | 482/107 |
| 1,917,566 | A * | 7/1933 | Wood | 482/108 |
| 4,529,198 | A * | 7/1985 | Hettick, Jr. | 482/104 |
| 4,691,916 | A * | 9/1987 | Voris | 482/98 |
| 6,186,927 | B1 * | 2/2001 | Krull | 482/98 |
| 6,387,022 | B1 * | 5/2002 | Smith | 482/106 |
| 7,052,445 | B2 * | 5/2006 | Ekhaus | 482/93 |
| 7,252,627 | B2 * | 8/2007 | Carter | 482/98 |
| 7,335,139 | B2 * | 2/2008 | Bartholomew et al. | 482/97 |
| 7,381,157 | B2 * | 6/2008 | Blateri | 482/50 |
| 7,413,532 | B1 * | 8/2008 | Monsrud et al. | 482/99 |
| 7,491,157 | B1 * | 2/2009 | Lin | 482/108 |
| 7,563,208 | B1 * | 7/2009 | Chen | 482/93 |
| 7,731,640 | B1 * | 6/2010 | Chen | 482/93 |
| 7,762,933 | B1 * | 7/2010 | Yu | 482/107 |
| 7,811,212 | B2 * | 10/2010 | Chen | 482/107 |
| 2005/0003931 | A1 * | 1/2005 | Mills et al. | 482/5 |
| 2008/0081744 | A1 * | 4/2008 | Gormley | 482/93 |
| 2009/0062085 | A1 * | 3/2009 | Polevoy et al. | 482/93 |
| 2010/0120589 | A1 * | 5/2010 | Krull | 482/93 |
| 2011/0028285 | A1 * | 2/2011 | Towley et al. | 482/108 |

* cited by examiner

*Primary Examiner* — Loan Thanh
*Assistant Examiner* — Victor K Hwang

(57) ABSTRACT

An adjustable weight kettlebell includes a weight lifting member that rests on top of a vertical stack of weights. A weight selector is rotatable into and out of underlying engagement of the weight plates to secure a desired amount of mass to the weight lifting member.

19 Claims, 12 Drawing Sheets

ADJUSTABLE WEIGHT KETTLEBELL

CROSS-REFERENCE TO RELATED APPLICATIONS

Disclosed herein is subject matter that is entitled to the filing date of U.S. Provisional Application No. 61/198,619, filed on Nov. 7, 2008; and U.S. Provisional Application No. 61/205,509, filed Jan. 20, 2009.

FIELD OF THE INVENTION

The present invention relates to methods and apparatus for adjusting weight on an exercise kettlebell.

BACKGROUND OF THE INVENTION

Exercise kettlebells are known in the art. An object of the present invention is to provide readily adjustable kettlebells.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of a kettlebell having a handle, a weight supporting section that is secured to the handle and disposed beneath the handle, and a weight selector that is rotatably mounted on the weight supporting section. Weights are sized and configured to occupy the weight supporting section, and to be selectively engaged and disengaged in response to rotation of the weight selector. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts throughout the several views.

DETAILED DESCRIPTION OF A PREFERRED EMBODIMENT

Figure 1:
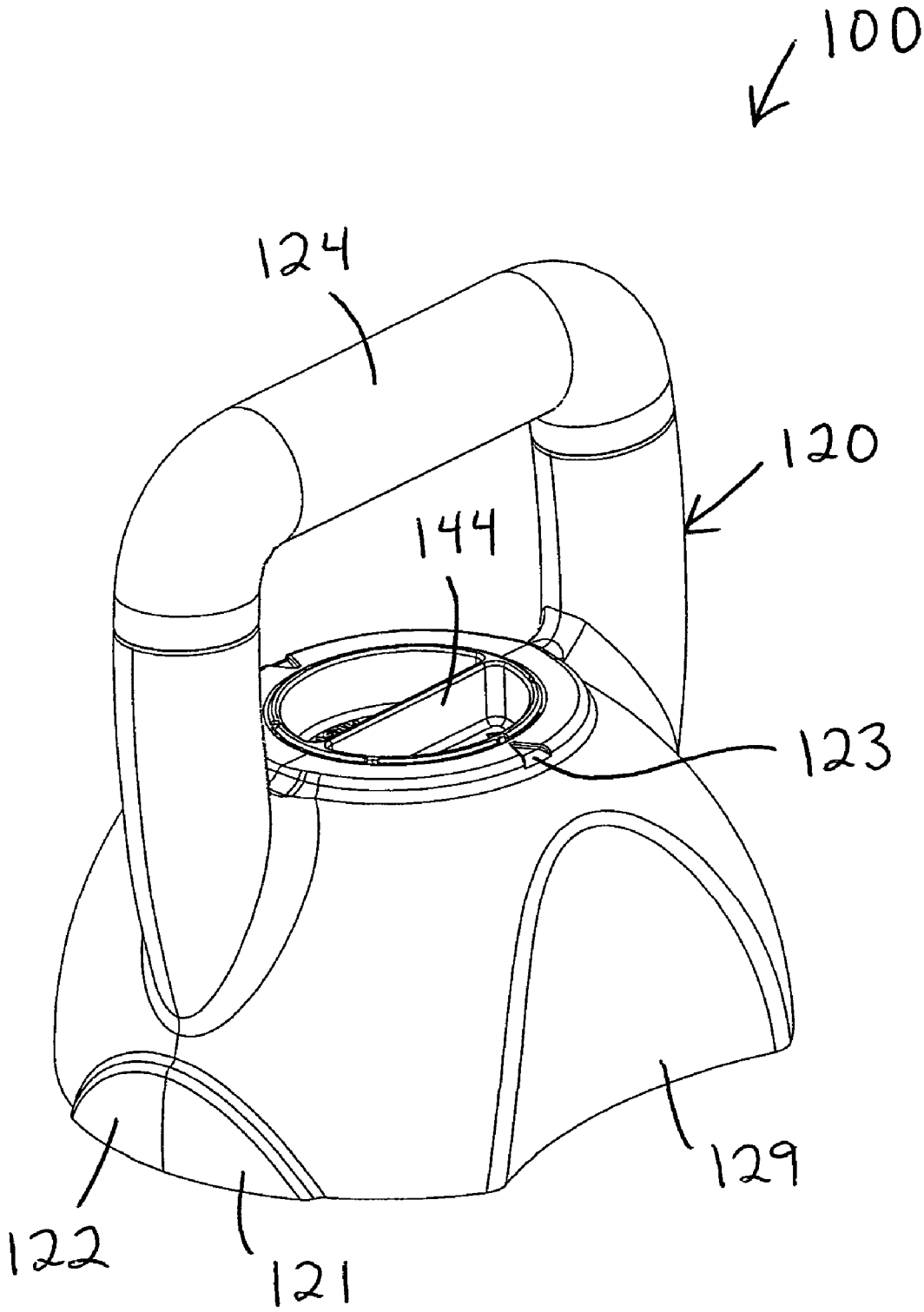
FIG. 1 is a perspective view of an adjustable weight kettlebell constructed according to the principles of the present invention.
Figure 2:
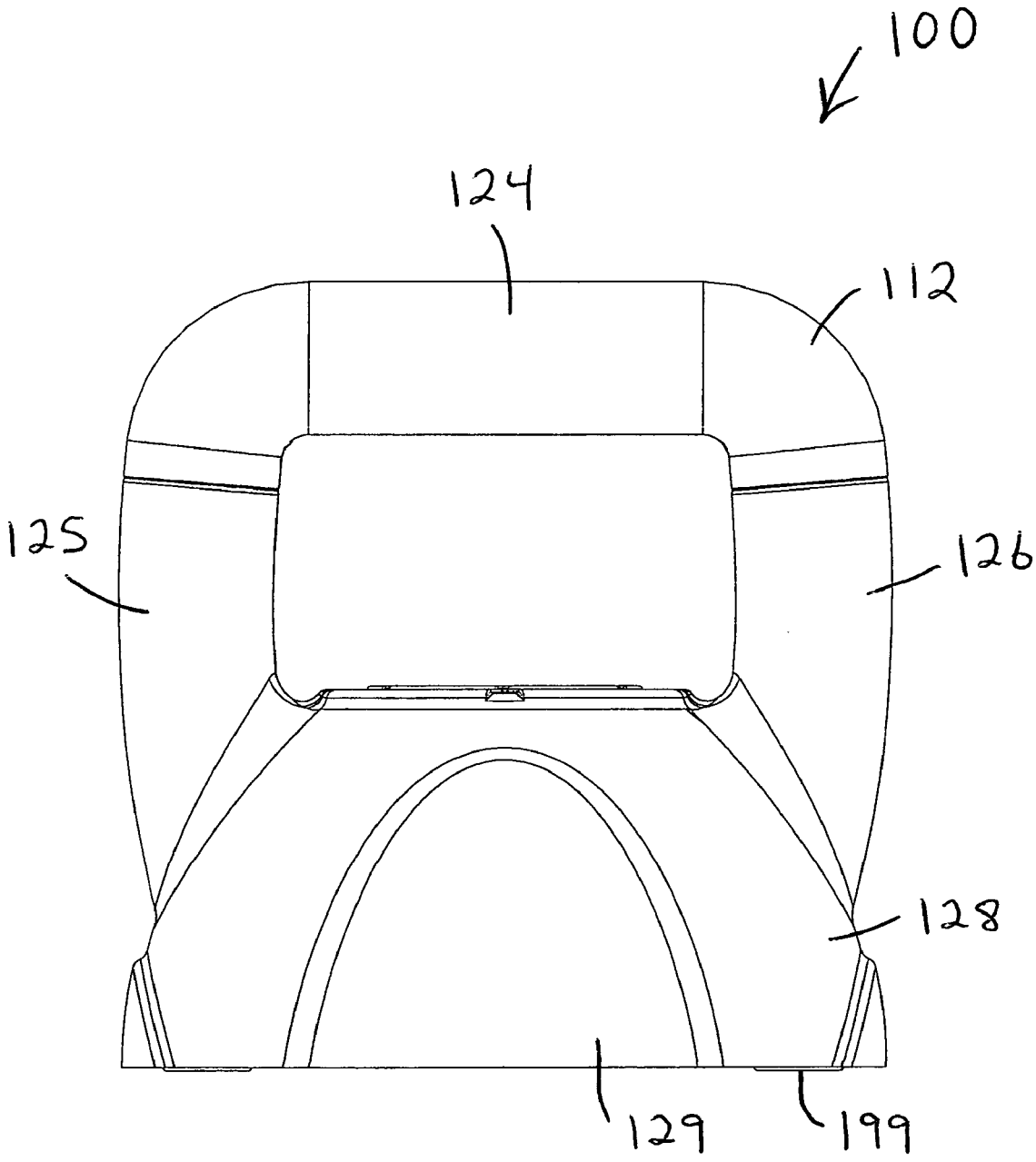
FIG. 2 is a front view of the kettlebell of FIG. 1.

FIGS. 1-2 show an exercise kettlebell 100 constructed according to the principles of the present invention. The kettlebell 100 includes a weight lifting member or handle member 120, and at least two weights 180 and 190 selectively secured to the weight lifting member 120 by means of a weight selector 140 that is rotatably mounted on the weight lifting member 120.

The weight lifting member 120 is preferably made by connecting two injection molded parts or halves 121 and 122 to one another (via sonic welding, adhesive, fasteners, snap fit, and/or other means known in the art). The weight lifting member 120 includes a centrally located, horizontal handlebar 124 that is sized and configured for grasping. The handlebar 124 is integrated into the molded parts 121 and 122, but may be provided as a separate part on an alternative embodiment. The handlebar 124 is shown with a vinyl overcoat 112. The weight lifting member 120 also includes left and right, vertical handle segments 125 and 126, which cooperate with the handlebar 124 to define an inverted U-shaped handle having three discrete graspable segments. An inverted U-shaped metal bar (not shown) is preferably disposed inside the inverted U-shaped handle to enhance structural integrity and provide some ballast weight.

The lower ends of the segments 125 and 126 are connected to a weight supporting section 128, which may be described as a downwardly opening housing or shell that is preferably sized and configured to cover, encompass, and fit over the weights 180 and 190. The weight supporting section 128 cooperates with a peripheral portion of at least the upper weight 180 to maintain a desired orientation between the weight lifting member 120 and at least the upper weight 180. Recesses or scallops 129 are provided in the front and back sidewalls of the housing 128 to accommodate or bear against a person's forearm.

Figure 3:
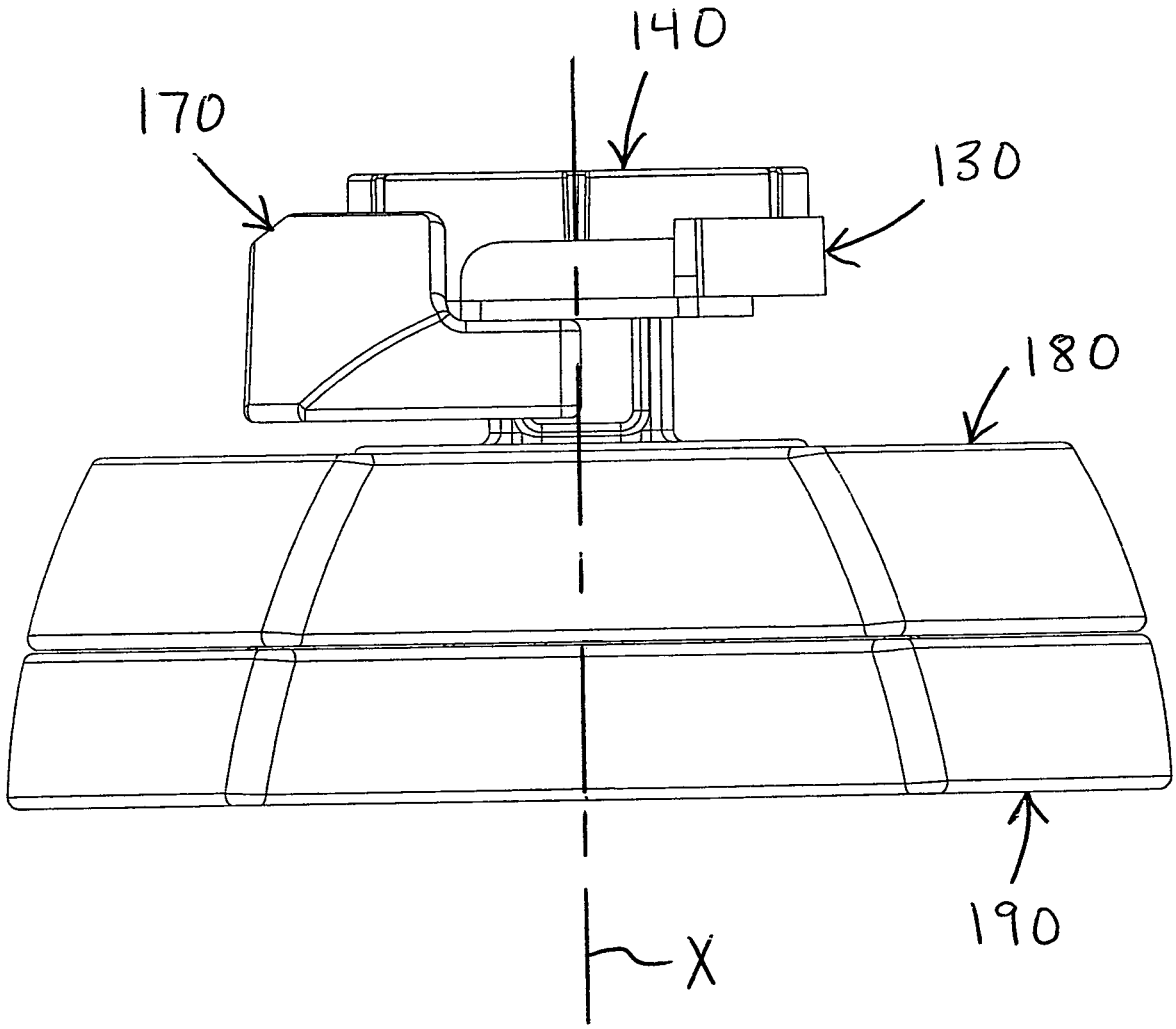
FIG. 3 is a front view of certain components of the kettlebell of FIG. 1.

The weight lifting member 120 is also preferably configured to receive and retain ballast or fixed weights 170 between the two molded parts 121 and 122. One of the fixed weights 170 is shown in FIG. 3, and the other fixed weight is identical thereto and occupies a diametrically opposed position relative to the weight selector 140. On the embodiment 100, the two fixed weights 170 cooperate with the other parts of the handle member 120 to define a starting weight or minimum weight of four pounds. Each of the weights 180 and 190 is also configured to weigh four pounds. In other words, the kettlebell 100 is selectively adjustable between four and twelve pounds in four pound increments.

Figure 4:
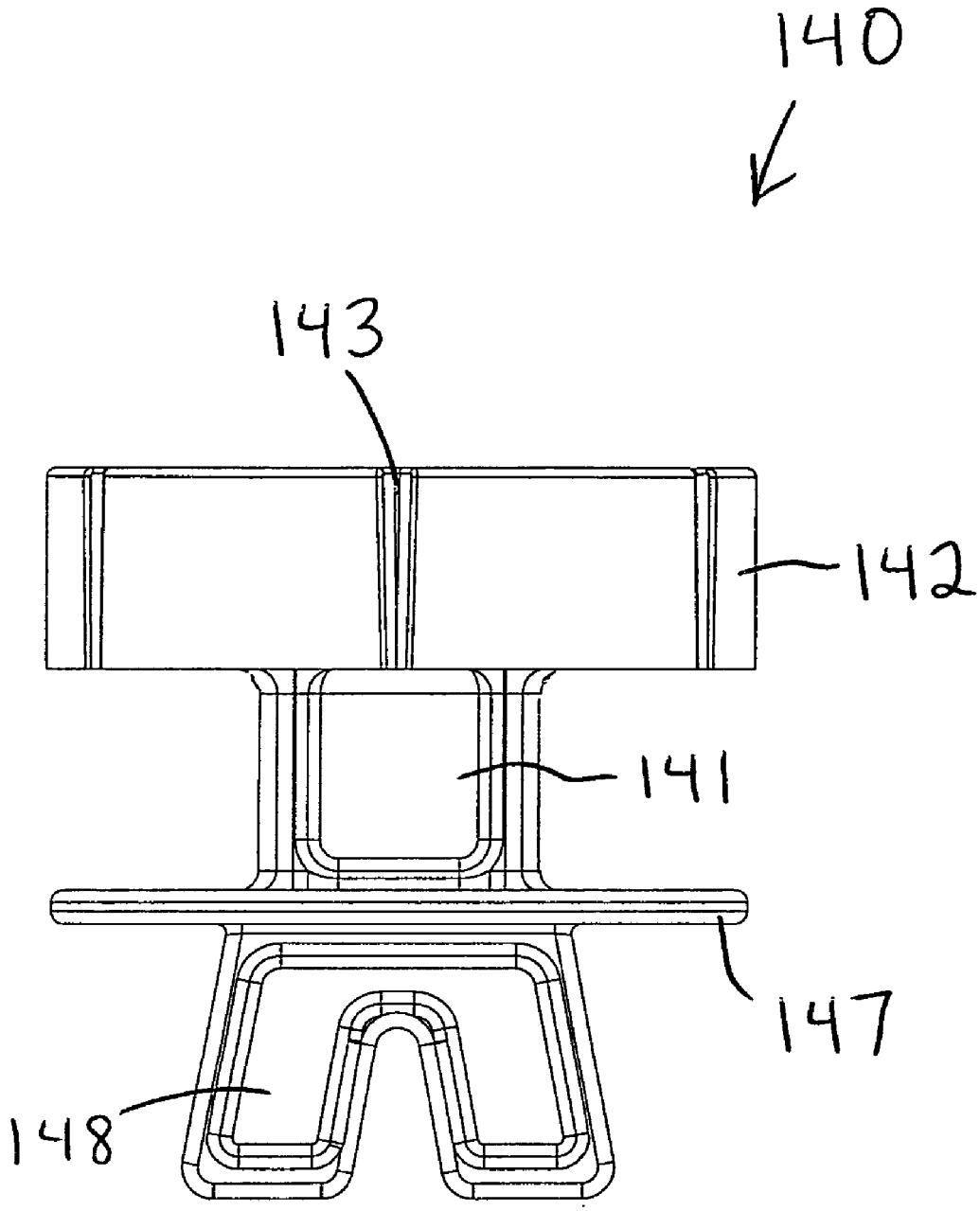
FIG. 4 is a front view of a weight selector shown in FIG. 3.
Figure 5:
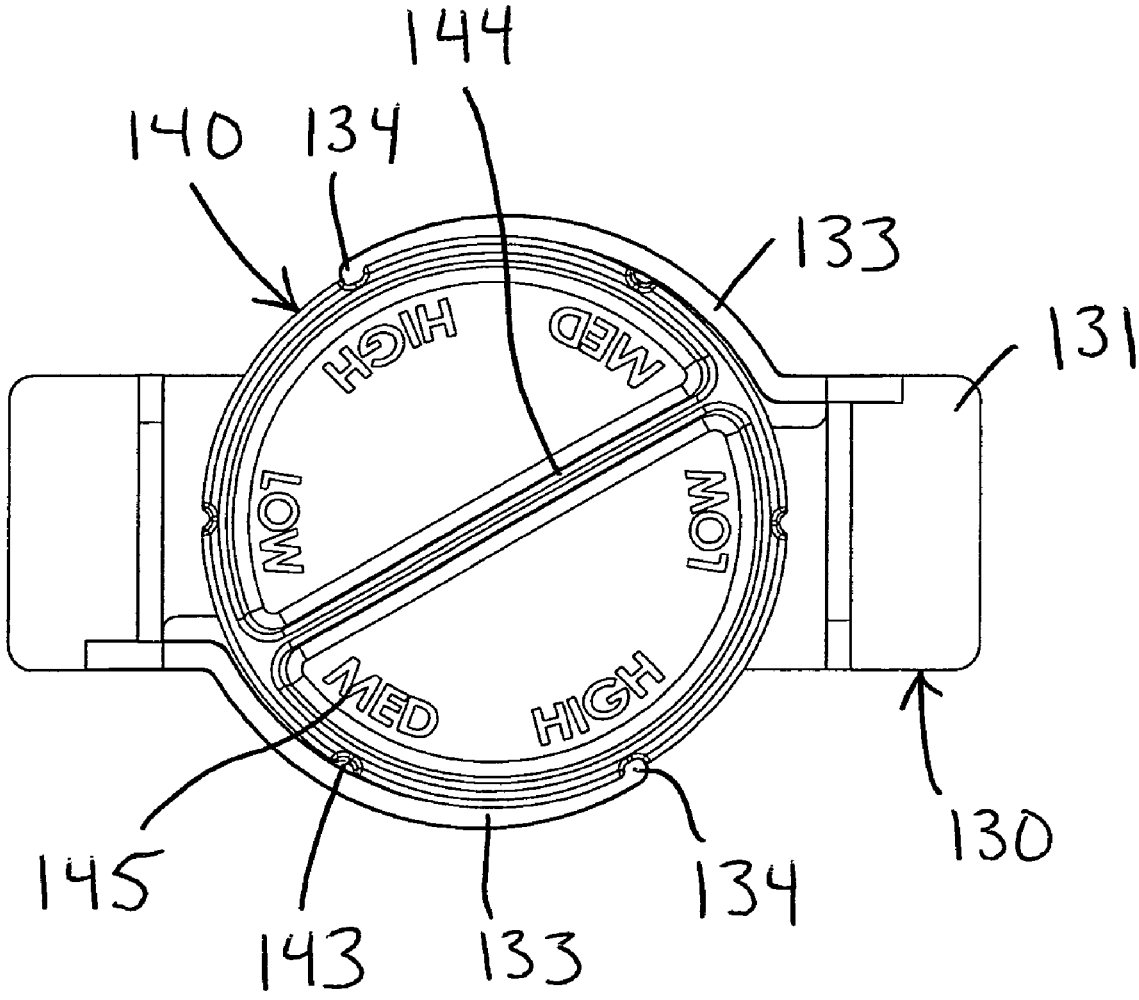
FIG. 5 is a top view of the weight selector of FIG. 4 shown in relation to a biasing member that appears in FIG. 3.

The weight selector 140, which is preferably a unitary piece of injection molded plastic, is shown by itself in FIG. 4. The weight selector 140 includes a neck or shaft 141 that extends vertically between an upper knob 142 and lower flange 147. The parts 121 and 122 include horizontal wall sections that fit about the shaft 141 to rotatably connect the weight selector 140 to the weight lifting member 120. Vertical grooves 143 extend into the outer sidewall of the knob 142 at locations that are circumferentially spaced sixty degrees apart from one another. The knob 142 may be described as a cylindrical shell that opens upward. As shown in FIG. 5, an internal wall or flange 144 projects diametrically across the interior of the knob 142 to facilitate grasping between a person's thumb and forefinger. Indicia 145 are provided on the upwardly facing, bottom wall of the knob 142 at locations that align radially with respective grooves 143. Diametrically opposed pointers 123 are provided on the weight lifting member 120 just beyond the circumference of the knob 142. An inverted V-shaped tab 148 projects downward from the lower flange 147 and selectively engages the weights 180 and 190, as further described below.

Different arrangements or means may be used to bias the weight selector 140 toward desired orientations relative to the weight lifting member 120 and the weights 180 and 190, and/or to lock the weight selector 140 in desired orientations relative to the weight lifting member 120 and the weights 180 and 190. For example, a leaf spring may be integrated into the weight selector 140 and biased to occupy detent locations defined by the weight lifting member 120 in an arc about the flange 147. In the alternative, a plunger may be mounted on the weight lifting member 120 and biased to occupy detent locations defined by the flange 147 at circumferential locations about the flange 147.

On the depicted embodiment 100, a biasing component 130 is secured in place between the parts 121 and 122. The biasing component 130 is shown together with the weight selector 140 in FIG. 5. The biasing component 130 includes a base 131 that is fixed in place relative to the weight lifting member 120, and diametrically opposed leaf springs 133 that are integrally connected to the base 131. A nub 134 is mounted on the end of each leaf spring 133 and configured to be received within an aligned groove 143 on the knob 140.

Figure 6:
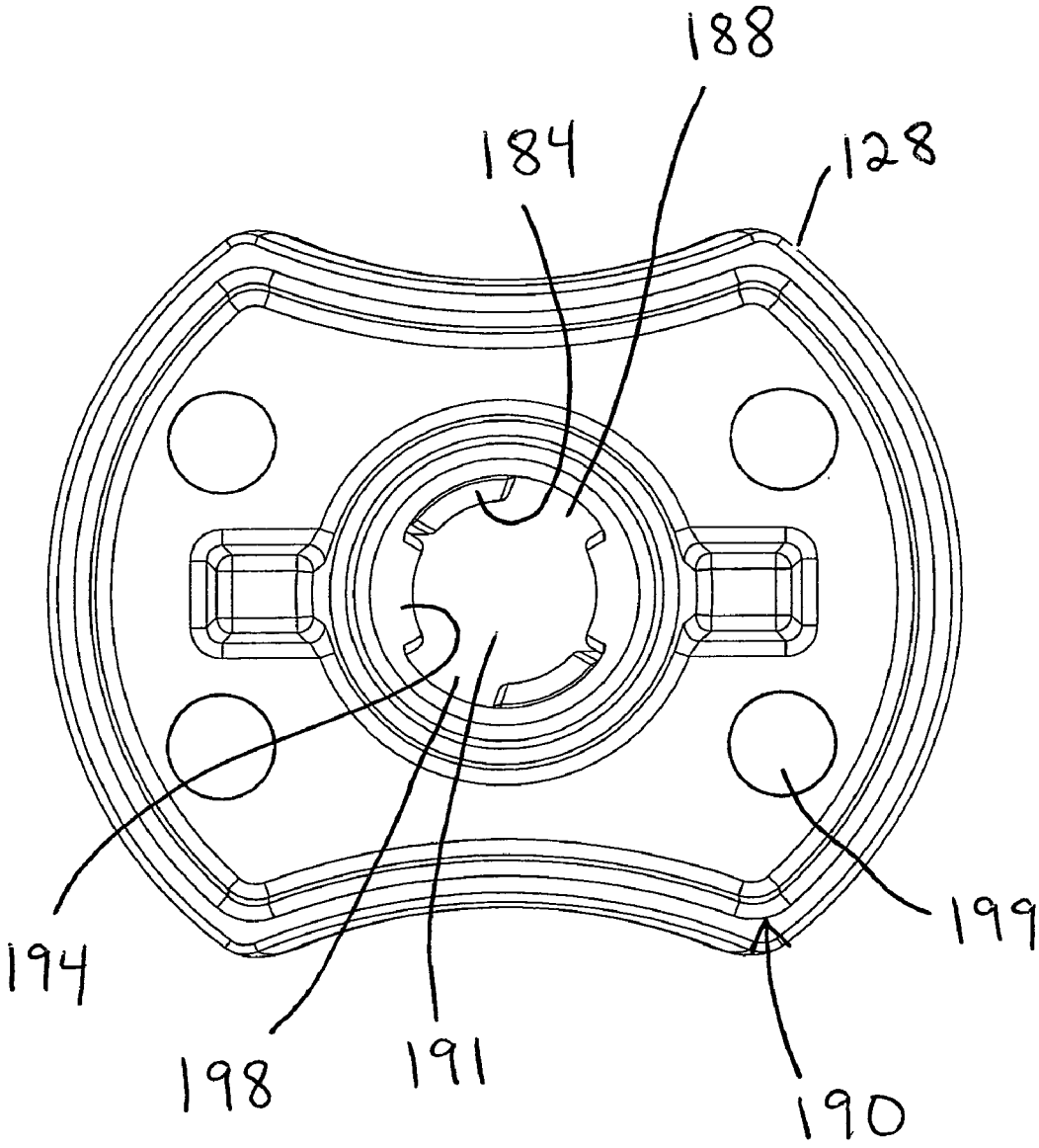
FIG. 6 is a bottom view of first and second stacked weight plates that appear in FIG. 3, as well as the outer housing shown in FIGS. 1-2.

The weights 180 and 190 are stacked as shown in FIGS. 3 and 6 to fit within the weight supporting housing 128, and to accommodate insertion of the weight selector 140 into openings in the weights 180 and 190. Each weight 180 and 190 is preferably a forged metal part. Alternatively, the weights 180 and 190 may be made in different manners and/or from different materials, including, for example, an injection molded plastic shell that surrounds and contains a relatively denser filler material. In any event, each weight 180 and 190 may be described as a plate having a thickness that is measured parallel to the selector axis of rotation X (shown in FIG. 3).

Figure 7:
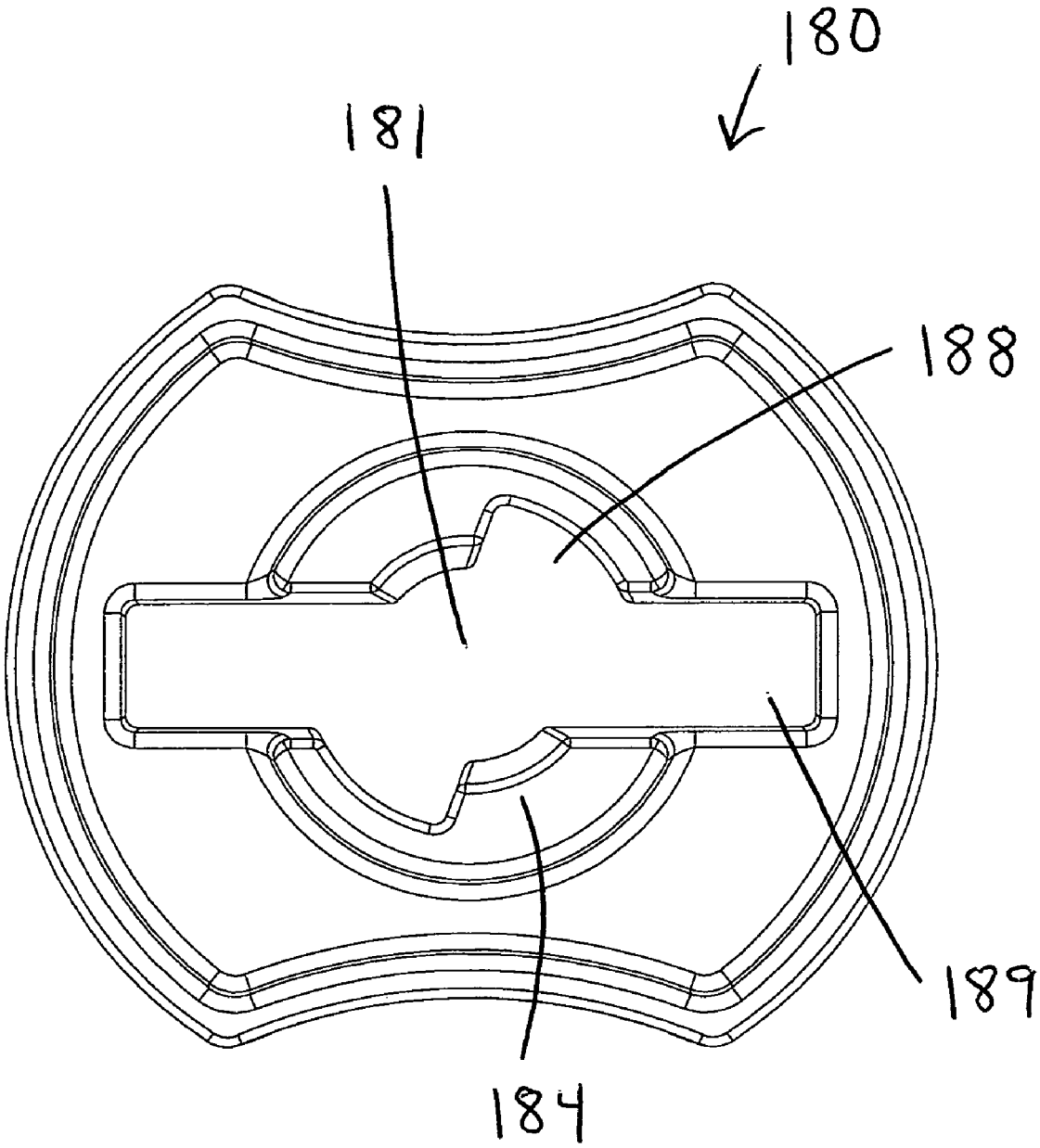
FIG. 7 is a bottom view of the upper weight plate of FIG. 3.

As shown in FIG. 7, a centrally located opening 181 extends through the upper weight 180, in a direction perpendicular to the thickness of the upper weight 180. The opening 181 may be described in terms of a conical bore that is bounded by diametrically opposed tabs 184 and diametrically opposed notches 188, and that is intersected diametrically by a straight-walled slot or keyway 189. As shown in FIG. 6, the slot 189 accommodates diametrically opposed lobes 194 on the lower weight plate 190 when properly oriented relative thereto. The conical bore accommodates rotation of the weight selector 140 when the tab 148 occupies the opening 181, and the tabs 184 overlie the tab 148 when the weight selector 140 is properly oriented relative thereto.

As shown in FIG. 6, a centrally located opening or conical bore 191 extends through the lower weight 190, in a direction perpendicular to the thickness of the lower weight 190. Diametrically opposed notches 198 in the conical bore 191 are defined between the lobes 194. The lower weight 190 preferably includes protrusions or posts 199 that project downward from its downwardly facing or bottom surface, thereby elevating the bulk of the weight 190, as well as the weight lifting member 210, relative to an underlying support surface.

Figure 8:
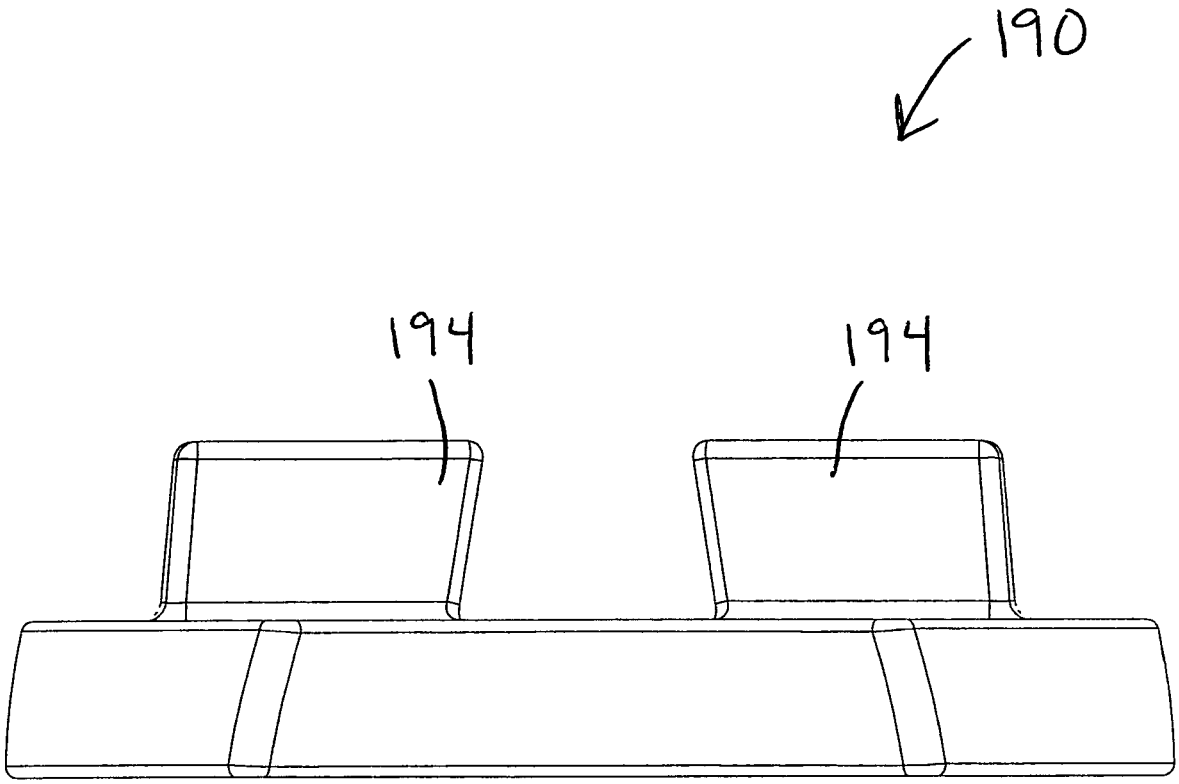
FIG. 8 is a front view of the lower weight plate of FIG. 3.

As shown in FIGS. 6 and 8, the lobes 194 project upward from the lower weight 190, and they have opposing sidewalls that define an extension of the conical bore 191. When the upper weight 180 is resting on top of the lower weight 190, the lobes 194 project through the slot 189 in the upper weight 180, thereby registering the two plates 180 and 190 in alignment with one another. Also, the opposing sidewalls of the lobes 194 assume positions of conical alignment with the tabs 184 on the upper weight 180. In other words, the lobes 194 accommodate rotation of the weight selector 140 when the tab 148 occupies the opening 181 in the upper weight plate 180, and the opposing sidewalls of the lobes 194 overlie the tab 148 when the weight selector 140 is properly oriented relative thereto. In this regard, the openings 181 and 191 cooperate to define three different weight selecting orientations for the weight selector 140, disposed at sixty degree intervals.

When the selector tab 148 is aligned with the notches 188 in the upper weight 180 and the notches 198 in the lower weight 190, the tab 148 is free to move upward relative to the upper weight 180 and the lower weight 190, so the weight lifting member 120 is free to move upward by itself (in response to a lifting force of at least four pounds). In this orientation, shown in FIG. 5, each "LOW" notation 145 aligns with a respective pointer 123 on the weight lifting member 120.

When the selector tab 148 is rotated beneath the tabs 184 on the upper weight 180, the tab 148 underlies the upper weight 180, but remains free to move upward relative to the lobes 194 on the lower weight 190, so only the upper weight 180 is constrained to move upward with the weight lifting member 120 (in response to a lifting force of at least eight pounds). In this orientation, each "MED" notation 145 aligns with a respective pointer 123 on the weight lifting member 120.

When the selector tab 148 is rotated beneath the lobes 194 on the lower weight 190, the tab 148 underlies the lower weight 190, so both weights 180 and 190 are constrained to move upward with the weight lifting member 120 (in response to a lifting force of at least twelve pounds). When the selector 140 is oriented in this manner on the depicted embodiment 100, the tab 148 rotates out from under the upper weight 180. In this orientation, shown in FIG. 1, each "HIGH" notation 145 aligns with a respective pointer 123 on the weight lifting member 120. On an alternative embodiment, the relevant parts may be reconfigured to keep the tab 148 in engagement with the upper weight when the lower weight is engaged.

Figure 9:
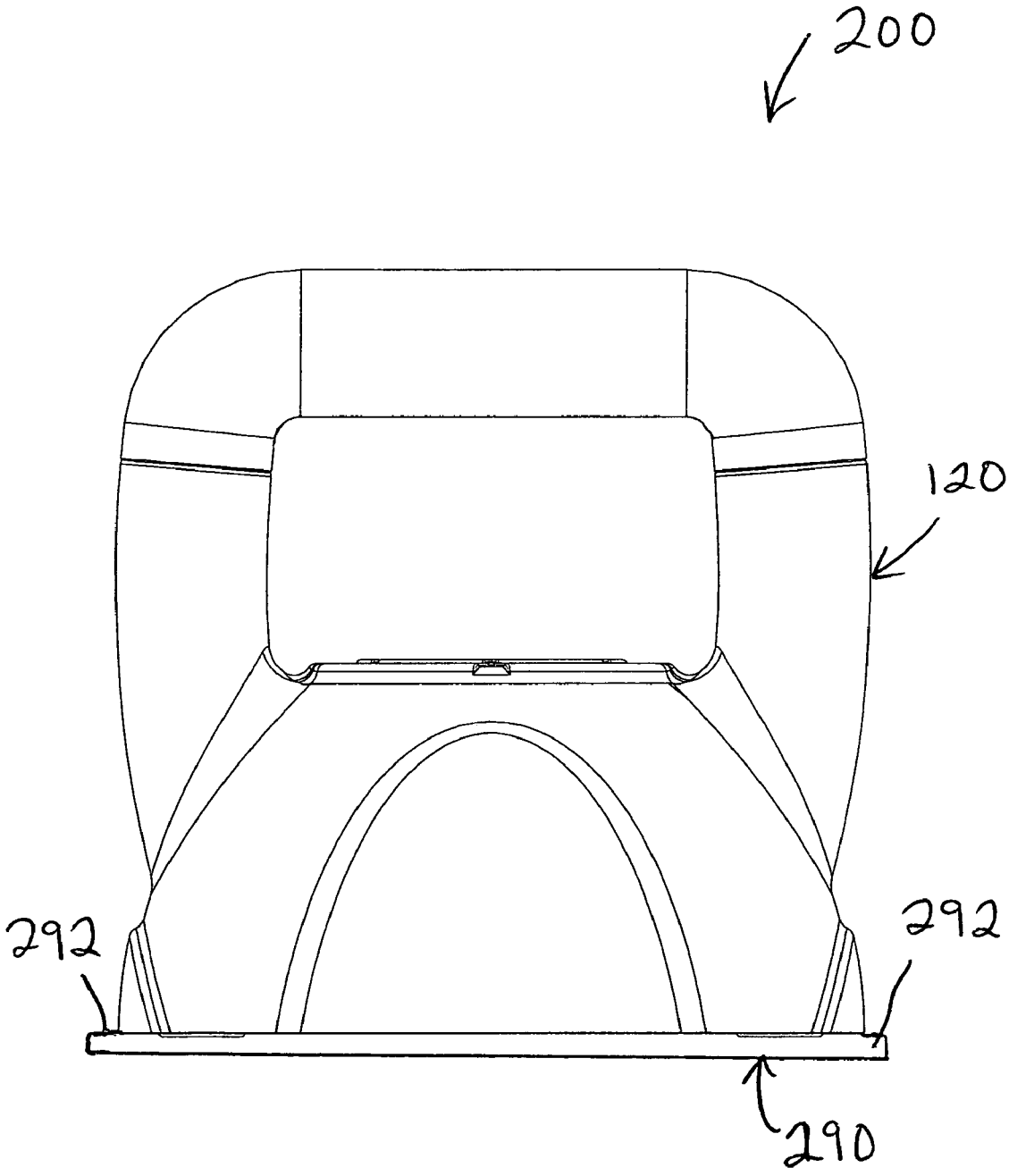
FIG. 9 is a front view of an alternative embodiment kettlebell constructed according to the principles of the present invention.

FIG. 9 shows an alternative embodiment kettlebell 200 that is similar to the kettlebell 100, except for the configuration of the lower weight 290. In this regard, the lower weight 290 has a lower section that extends downward beneath the lower edge of the housing 128, and projects laterally outward beyond the perimeter of the lower edge of the housing 128, thereby defining an outermost flange 292. An advantage of this arrangement is that the metal weight 290 will be braced against the product packaging, instead of the plastic housing 128. Also, a vinyl coating may be disposed about the flange 292 and the bottom of the lower weight 290 to prevent marring of an underlying floor surface, and the coating may be conveniently terminated along the intersection between the top of the flange 292 and the remaining sidewall of the lower weight 290.

Figure 10:
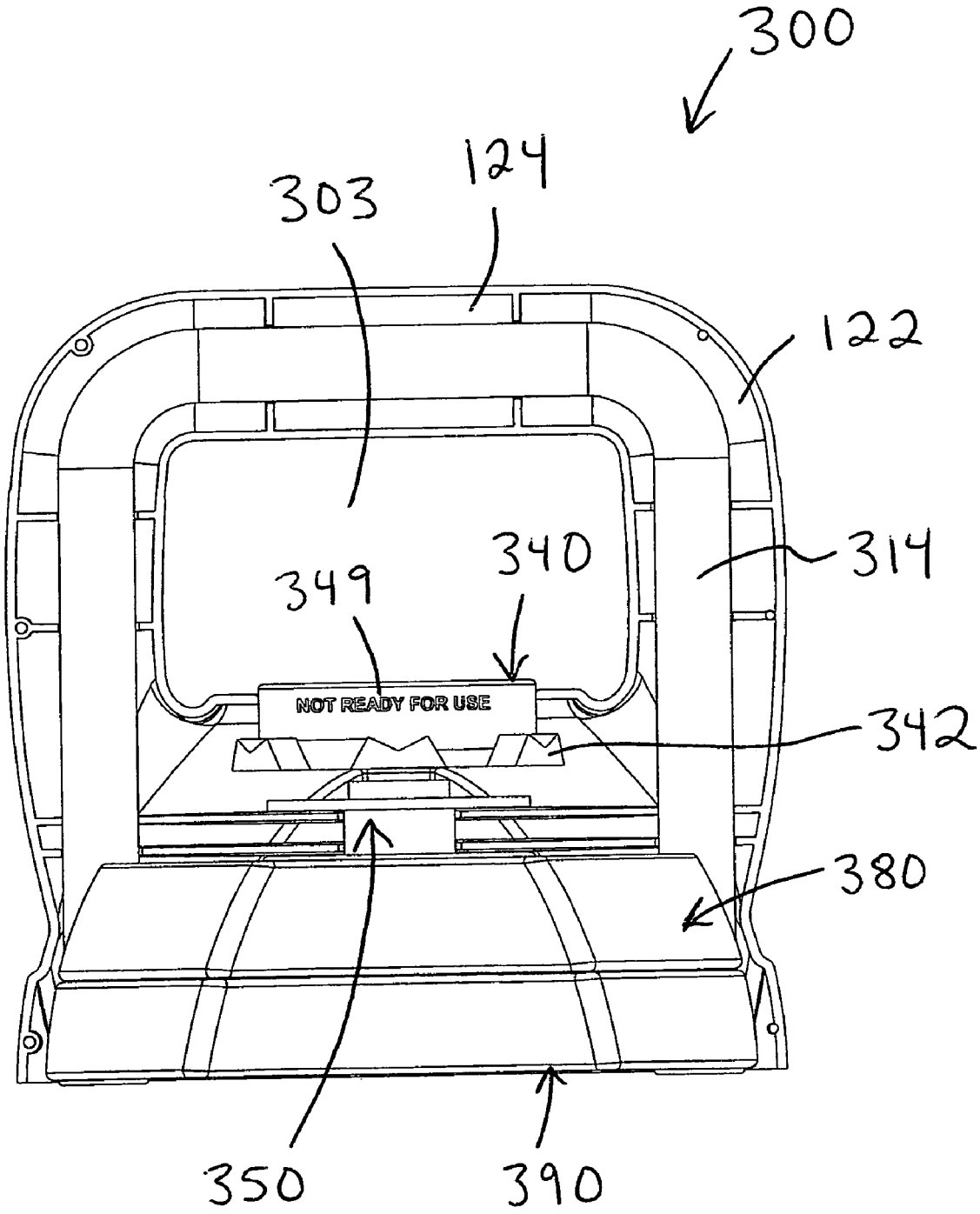
FIG. 10 is a front view of another alternative embodiment kettlebell constructed according to the principles of the present invention, with a proximate half of the housing removed, and the weight selector in a "ready for use" position.
Figure 11:
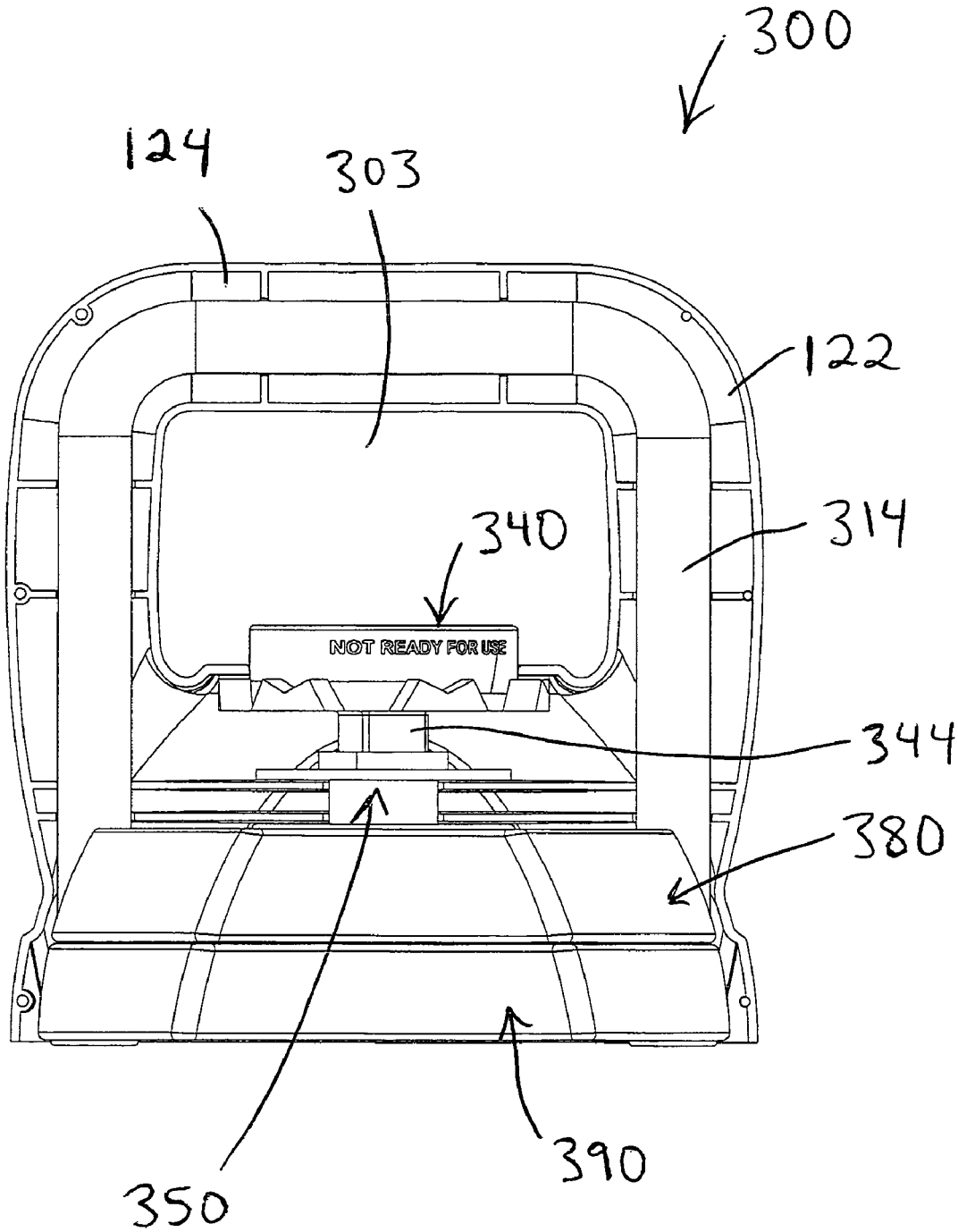
FIG. 11 is a front view of the kettlebell of FIG. 10, with the weight selector in a "not ready for use" position.
Figure 12:
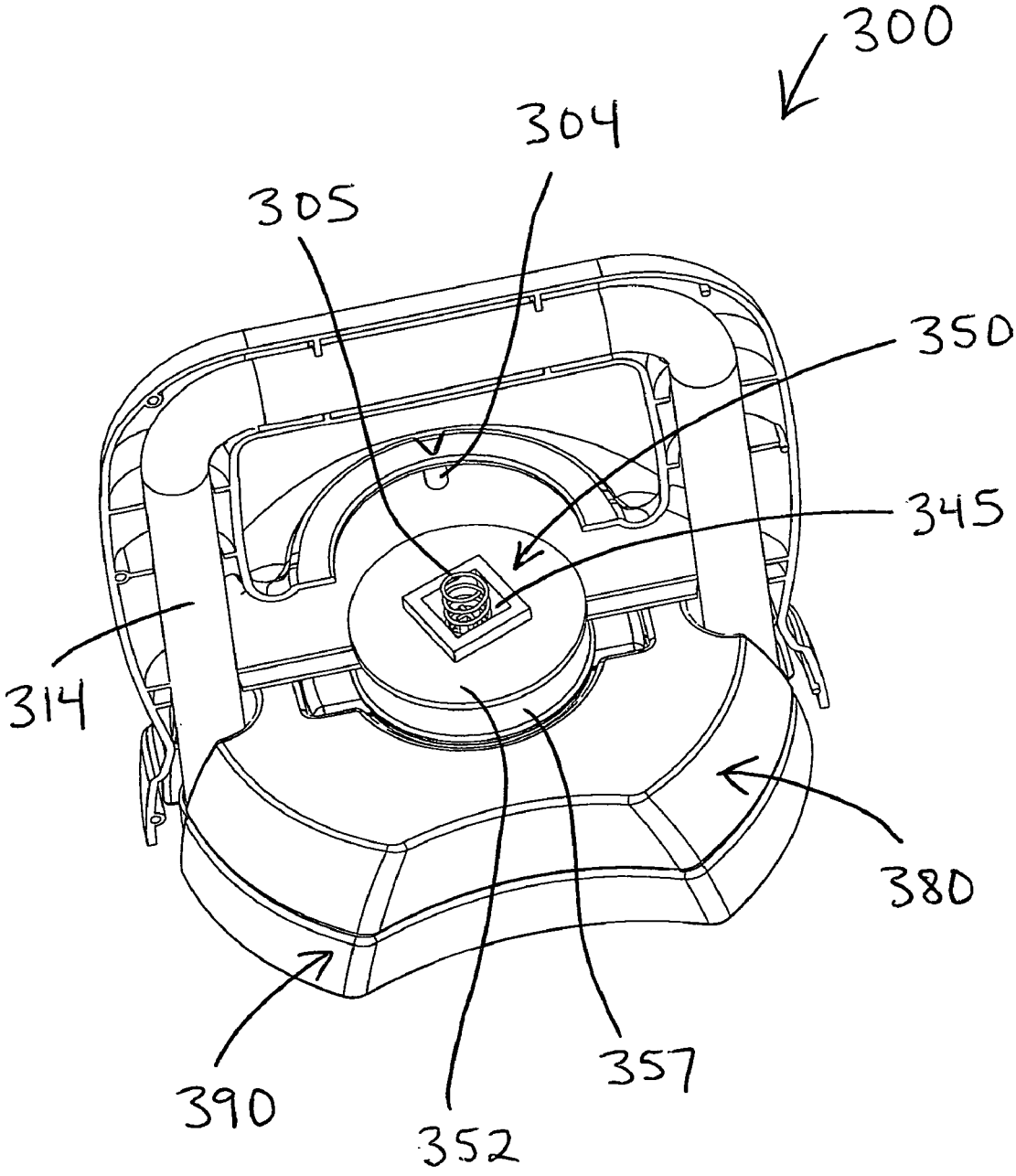
FIG. 12 is a perspective view of certain components of the kettlebell of FIG. 10.

FIGS. 10-12 show another alternative embodiment kettlebell 300 that is similar to the first kettlebell 100, except as noted below. One distinction is that the kettlebell 300 has a relatively longer inverted U-shaped steel bar 314 that extends through the handle 124 and through, or at least downward beyond the weights 380 and 390. An advantage of this arrangement is that the bar 314 provides reinforced structural support to accommodate pushing the kettlebell 300 downward against an underlying floor surface (during the performance of a push-up, for example). The weights 380 and 390 are similar to the weights 180 and 190, except for changes to accommodate passage of the bar 314. Since the weights 180 and 190 are cored from below, as shown in FIGS. 6 and 7, the weights 380 and 390 will fit within the same housing 128 as the weights 180 and 190 without affecting the available weight increments. A related benefit of coring the weights 180 and 190 is that they can be replaced by non-cored weights that are two kilograms each. By increasing the ballast weight, as well, the same parts 121 and 122 may be used to make a kettlebell that adjusts from two to six kilograms in two kilogram increments.

The increased size of the bar 314 reduces the need for ballast weight on the kettlebell 300. On another alternative embodiment, the bar 314 may be replaced by a cast iron part having relatively larger distal ends or feet that are separated from the weights by vertical planes that align with the opposing sides of the U-shaped cast member, thereby providing more surface area to engage the floor, and eliminating the need for separate ballast weights.

Another distinction between the kettlebell 300 and the kettlebell 100 is that the weight selector 140 has been replaced by a weight selector 350, a separate knob 340, and a compressed spring 305. With reference to FIG. 12, the weight selector 350 includes upper and lower flanges 352 and 357 with a shaft (not shown) extending between the flanges 352 and 357. As on the embodiment 100, ribs on the parts 121 and 122 rotatably capture opposite sides of the shaft. A square bore 345 projects downward through the flange 352 and into the shaft. A helical coil spring 305 is positioned within the bore 345 as shown. The lower end of the weight selector 350 engages the weights 380 and 390 in the same manner as the selector tab 148 engages the weights 180 and 190.

As shown in FIGS. 10-11, the knob 340 has a square shaft 344 that inserts or telescopes into the bore 345 in the weight selector 350, and that constrains the two parts to rotate together. The shaft 344 is tubular to receive the upper end of the spring 305. Warning text 349 is disposed about the circumference of the knob 340, and the knob 340 has the same flange 144 and indicia 145 as the knob 140. Tabs 342 having M-shaped profiles project radially outward from the knob at locations disposed beneath the warning text 349 and spaced circumferentially at sixty degree intervals. Diametrically opposed tabs 342 align with diametrically opposed pegs 304 on the parts 121 and 122 (see FIG. 12) when the indicia 145 on the knob 340 align with the pointers 123 on the parts 121 and 122. When so aligned, the knob 340 occupies a first elevation relative to the parts 121 and 122, as shown in FIG. 10, below a gap 303 beneath the handle 124, and placing the warning text 349 within the confines of the parts 121 and 122.

When the pegs 304 are disposed between adjacent tabs 342, the indicia 145 on the knob 340 do not align with the pointers 123 on the parts 121 and 122. When in any such orientation, the knob 340 occupies a relatively higher, second elevation relative to the parts 121 and 122, as shown in FIG. 11, projecting upward into the gap 303 beneath the handle 124, and placing the warning text 349 outside the confines of the parts 121 and 122. The angled sidewalls of the tabs 342 encourage the knob 340 to assume one of the two elevations relative to the parts 121 and 122. As a result of this arrangement, a user is notified if the weight selector 350 is not in one of six "ready-to-lift" orientations relative to the parts 121 and 122.

Each of the foregoing embodiments may be described in terms of an adjustable weight kettlebell, comprising: a stack of weights, including an upper weight that defines a first opening, and a lower weight that defines a second opening, wherein the upper weight is configured to occupy a predetermined position on top of the lower weight; a weight lifting member configured to rest on top of the upper weight, wherein the weight lifting member includes (a) a handle; (b) a weight engaging portion that registers with the upper weight; and (c) a weight selector having (i) a shaft that rotates about an axis relative to the weight engaging portion, and (ii) a weight retaining member rigidly connected to the shaft, wherein when the weight lifting member is resting on top of the upper weight, the weight retaining member occupies each said opening and is selectively rotatable into underlying engagement of each said weight; and when the weight selector occupies a first orientation relative to the weight engaging portion, the weight retaining member is free to move upward relative to each said weight, whereby the weight lifting member is liftable without either said weight; and when the weight selector occupies a second orientation relative to the weight engaging portion, the weight retaining member underlies only the upper weight, whereby the weight lifting member is liftable together with the upper weight; and when the weight selector occupies a third orientation relative to the weight engaging portion of the weight lifting member, the weight retaining member underlies at least the lower weight, whereby the weight lifting member is liftable with each said weight.

The present invention has been described with reference to specific embodiments and a preferred application. Persons skilled in the art will recognize that features on various embodiments may be mixed and matched to arrive at additional embodiments. Moreover, this disclosure will enable persons skilled in the art to derive various modifications, improvements, and/or applications that nonetheless embody the essence of the invention. Accordingly, the scope of the present invention is to be limited only to the extent of the following claims.

What is claimed is:

1. An adjustable weight kettlebell, comprising:

a stack of weights, including an upper weight that defines a first opening, and a lower weight that defines a second opening, wherein the upper weight is configured to occupy a predetermined position on top of the lower weight with a protuberance on the lower weight projecting upward into the first opening;

a weight lifting member configured to rest on top of the upper weight, wherein the weight lifting member includes (a) a handle connected to the weight lifting member, wherein the handle includes a hand grip configured and arranged for grasping in a person's hand at a location vertically above the stack when the weight lifting member is resting on top of the upper weight in the stack; (b) a weight engaging portion that registers with the upper weight; and (c) a weight selector having (i) a shaft that rotates about an axis relative to the weight engaging portion, and (ii) a weight retaining member rigidly connected to the shaft, wherein when the weight lifting member is resting on top of the upper weight, the weight retaining member occupies each said opening and is selectively rotatable into underlying engagement of each said weight; and when the weight selector occupies a first orientation relative to the weight engaging portion, the weight retaining member is free to move upward relative to each said weight, whereby the weight lifting member is liftable without any said weight; and when the weight selector occupies a second orientation relative to the weight engaging portion, the weight retaining member underlies only the upper weight, whereby the weight lifting member is liftable together with the upper weight; and when the weight selector occupies a third orientation relative to the weight engaging portion of the weight lifting member, the weight retaining member underlies at least the lower weight, whereby the weight lifting member is liftable with each said weight.

2. The adjustable weight kettlebell of claim 1, wherein rotation of the weight selector from the second orientation to the third orientation rotates the weight retaining member out from underlying engagement of the upper weight.

3. The adjustable weight kettlebell of claim 1, wherein the weight selector directly underlies the protuberance when in the third orientation.

4. The adjustable weight kettlebell claim 3, wherein a lowermost portion of the weight selector is disposed inside the first opening in the upper weight when the lifting member is resting on top of the stack.

5. The adjustable weight kettlebell of claim 1, wherein the upper weight is disposed inside a closed curve sidewall of the weight engaging portion.

6. The adjustable weight kettlebell claim 1, wherein a lowermost edge of the weight selector is disposed inside the first opening in the upper weight when the lifting member is resting on top of the stack.

7. The adjustable weight kettlebell of claim 1, wherein the weight lifting member includes a manually operable knob, and rotation of the knob is linked to rotation of the weight selector.

8. The adjustable weight kettlebell of claim 7, wherein the knob is mounted in telescoping fashion on the weight selector.

9. The adjustable weight kettlebell of claim 8, wherein a spring is compressed between the weight selector and the knob.

10. The adjustable weight kettlebell of claim 9, wherein the knob is configured to occupy a lower position on the weight lifting member when the weight selector occupies the second orientation and alternatively, the third orientation, and the knob is configured to occupy a relatively higher position on the weight lifting member when the weight selector occupies a fourth orientation, disposed between the second orientation and the third orientation.

11. The adjustable weight kettlebell of claim 10, wherein warning indicia on the knob is visible when the knob occupies the fourth orientation, and the warning indicia are hidden when the knob occupies the second orientation and alternatively, the third orientation.

12. The adjustable weight kettlebell of claim 11, wherein the relatively higher position of the knob is relatively closer to the handle.

13. The adjustable weight kettlebell of claim 1, wherein an upper end of the weight selector is configured as a manually operable knob.

14. An adjustable weight kettlebell, comprising:

a stack of weights, including an upper weight and a lower weight, wherein the upper weight is configured to occupy a predetermined position on top of the lower weight;

a weight lifting member configured to rest on top of the upper weight, wherein the weight lifting member includes (a) a handle; (b) a weight engaging member that registers with the upper weight; (c) an inverted U-shaped bar having a central portion that extends through the handle and first and second distal ends that define a lowermost edge of the weight lifting member when the weight lifting member is resting on the stack; and (d) a weight selector movably connected to the weight engaging member for movement between a first position, wherein the weight selector is free to move upward relative to each said weight; and a second position, wherein the weight selector underlies only the upper weight in the stack; and a third position, wherein the weight selector underlies at least the lower weight in the stack.

15. An exercise device, comprising:

an array of weights; and a weight lifting member configured to rest on top of the weights, wherein the weight lifting member includes (a) a handle including a handgrip sized and configured for grasping in a person's hand; (b) a weight engaging member configured to register with the weights, wherein the handle has opposite first and second ends rigidly connected to respective first and second sides of the weight engaging member; (c) a knob rotatably mounted on the weight engaging member for rotation about an axis; and (d) a weight selector movably mounted on the weight engaging member for movement into and out of underlying engagement with the weights in response to rotation of the knob, wherein the knob is biased to occupy a first axial position along the axis when the weight selector occupies a desired position relative to the weights, and the knob is biased to occupy a discrete, second axial position along the axis when the weight selector occupies an undesired position relative to the weights.

16. The exercise device of claim 15, wherein a safety warning is disposed on the knob, and the safety warning is visible when the knob occupies the second axial position, and the safety warning is shrouded by the weight engaging member when the knob occupies the first axial position.

17. The exercise device of claim 15, wherein a space is defined between a downwardly facing portion of the handgrip and an upwardly facing portion of the knob, and the space is relatively larger when the knob occupies the first axial position, and the space is relatively smaller when the knob occupies the second axial position.

18. The exercise device of claim 15, wherein a spring biases the knob toward the second axial position.

19. The exercise device of claim 15, wherein a spring biases the knob to remain in a desired orientation relative to the weight engaging member.

* * * * *